US005700189A

United States Patent [19]

Farris

[11] Patent Number: 5,700,189

[45] Date of Patent: Dec. 23, 1997

[54] KNIFE-BLADE SHARPENING APPARATUS

[76] Inventor: Jimmie L. Farris, 37106 Lake Rd., Shawnee, Okla. 74801

[21] Appl. No.: 678,578

[22] Filed: Jul. 8, 1996

[51] Int. Cl.[6] ..... B24D 15/08

[52] U.S. Cl. ..... 451/555; 451/558; 76/82; 76/88

[58] Field of Search ..... 451/555, 557, 451/558, 552, 319, 461; 76/82, 84, 88

[56] References Cited

U.S. PATENT DOCUMENTS

| | | | |
|---|---|---|---|
| D. 288,169 | 2/1987 | Cohen | D8/93 |
| D. 316,662 | 5/1991 | Cherniak | D8/93 |
| D. 327,402 | 6/1992 | Button et al. | D8/93 |
| D. 329,797 | 9/1992 | Baker | D8/93 |
| D. 333,081 | 2/1993 | Glesser | D8/91 |
| D. 337,253 | 7/1993 | Glesser | D8/91 |
| 3,719,461 | 3/1973 | Topping | 51/204 |
| 4,094,106 | 6/1978 | Harris | 51/214 |
| 4,197,677 | 4/1980 | Graves | 51/214 |
| 4,611,437 | 9/1986 | Cohen | 451/461 |
| 4,646,477 | 3/1987 | Robertson | 51/204 |
| 5,458,534 | 10/1995 | Canpione et al. | 451/555 |

FOREIGN PATENT DOCUMENTS

| | | | |
|---|---|---|---|
| 2601277 | 1/1988 | France | 451/557 |
| 2602706 | 2/1988 | France | 451/557 |
| 2164881 | 4/1986 | United Kingdom | 451/461 |

OTHER PUBLICATIONS

General Electric General Catalog 7730, dated Mar., 1981, entitled "Lucalox® Ceramic Tubing".

*Primary Examiner*—Robert A. Rose
*Attorney, Agent, or Firm*—Dougherty & Hessin, P.C.

[57] ABSTRACT

A blade-sharpening apparatus for knives and other cutting tools which uses a ceramic sharpening element. The sharpening element is a recycled aluminum oxide sodium vapor streetlight bulb. The vapor and heat expansion and contraction of the bulb during use as a light causes wear on the bulb and results in the ceramic element becoming more porous, thereby providing an abrasive surface suitable for blade sharpening. A first embodiment of the apparatus comprises a housing with a support substantially along a length of the sharpening element and a cover for enclosing the sharpening element when not in use. In the first embodiment, the sharpening element is supported on both ends. In a second embodiment, the sharpening element is supported on one end by a handle and a sleeve is provided to enclose the sharpening element when not in use. The sleeve may be attached to a portion of the handle opposite the sharpening element when in an operating position.

26 Claims, 1 Drawing Sheet

KNIFE-BLADE SHARPENING APPARATUS

BACKGROUND OF THE INVENTION

1. Field of the Invention

This invention relates to apparatus for sharpening blades of knives and similar objects, and more particularly, to a knife-sharpening apparatus utilizing a recycled sodium vapor light bulb as the sharpening medium.

2. Description of the Prior Art

In the past, numerous apparatus have been utilized for sharpening the blades of knives and other cutting tools such as scissors. In many of such devices, sharpening stones are utilized for sharpening the blade by moving an edge of the blade across the surface of the stone. Sharpening stones are made of an abrasive material which serves to wear away material on the knife. Such an apparatus is shown in U.S. Pat. No. 3,719,461 to Topping.

Another blade-sharpening device is disclosed in U.S. Pat. No. 4,094,106 to Harris. This apparatus includes an embodiment having an elongated hone which may be cylindrical with a handle 21 at one end thereof. In operation, the handle is held with one hand, and the knife is moved across the surface of the hone with the other hand.

One material which has been shown to be particularly effective in sharpening blades is a ceramic material which has an abrasive substance such as aluminum oxide dispersed therein. Such a sharpening apparatus is disclosed in U.S. Pat. No. 4,197,677 to Graves.

Functionally, ceramic knife sharpeners are very effective, but they have the disadvantage of being quite expensive because the ceramic sharpening elements are costly to produce. Therefore, there is a need for a ceramic knife sharpener which is relatively less expensive to manufacture. The present invention solves this problem by providing a knife-sharpening apparatus which utilizes a recycled street lamp bulb as the sharpening element or medium. Such bulbs are typically made of ceramic comprising aluminum oxide. Electrical utility companies simply throw away such bulbs, and therefore recycling them into knife sharpeners is quite inexpensive. This provides an economical knife-sharpening medium while also being friendly to the environment because the burned-out bulbs would have to be disposed of in some way or other.

SUMMARY OF THE INVENTION

The present invention is a blade-sharpening apparatus for knives and the like which utilizes a recycled street lamp bulb as the sharpening medium.

The blade-sharpening apparatus generally comprises a sharpening element comprising an aluminum oxide tube subjected to heat expansion and contraction cycles such that the surface thereof is made porous, and support means for supporting the sharpening element during a sharpening operation in which a blade of a knife, scissors or the like is repeatedly moved across an outer surface of the sharpening element. Preferably, the tube is a recycled aluminum oxide sodium vapor streetlight bulb. The bulb is elongated and is substantially cylindrical in cross section. The support means is engaged with at least one end of the sharpening element.

In a first embodiment, the support means provides supports along a substantial length of an outer surface of the sharpening element. In this embodiment, the apparatus further comprises a housing having a base portion, wherein the support means extends from the base portion. The support means and base portion may be integrally formed, but the invention is not intended to be limited to such a construction.

In the first embodiment, the base portion has a housing end extending therefrom, and the housing end defines an opening therein. An end of the sharpening element is disposed in the opening in the housing end. Preferably, there are two such housing ends, and the cover means is characterized by a cover extending longitudinally between the housing ends.

In a second embodiment, the support means is characterized by a handle defining an opening in an end thereof, and a proximate end of the sharpening element is disposed in the opening in the handle. In this embodiment, the cover means is characterized by a sleeve disposed around the sharpening element and adapted for tightly fitting engagement with a portion of the handle adjacent to the sharpening element when in a closed position. The sleeve is further adapted for tightly fitting engagement with another portion of the handle opposite the sharpening element when in an operating position.

Numerous objects and advantages of the invention will become apparent as the following detailed description of the preferred embodiments is read in conjunction with the drawings which illustrate such embodiments.

DETAILED DESCRIPTION OF THE PREFERRED EMBODIMENTS

The Embodiment Of FIGS. 1–4

Figure 1:
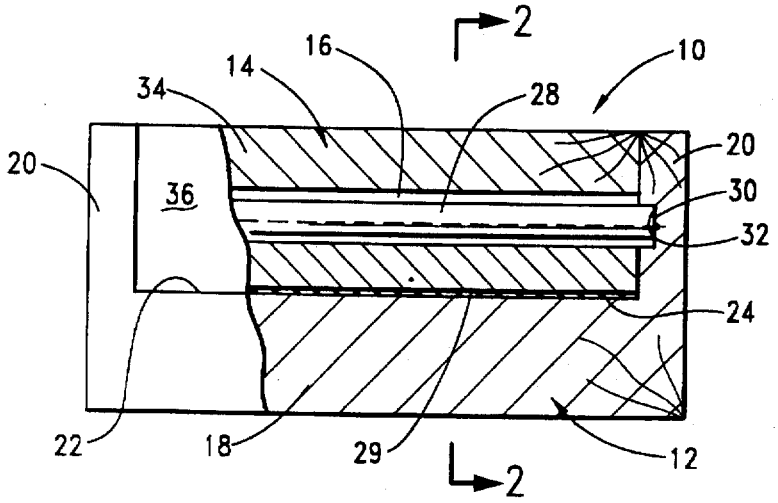
FIG. 1 shows a first embodiment of the knife-sharpening apparatus of the present invention in elevation and partial longitudinal cross section.
Figure 2:
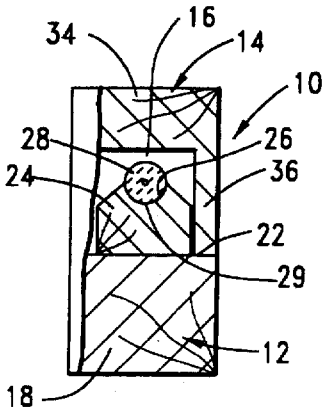
FIG. 2 shows an end elevation and partial cross section taken along lines 2—2 in FIG. 1.

Referring now to the drawings, and more particularly to FIGS. 1 and 2, a first embodiment of the knife-sharpening apparatus is shown and generally designated by the numeral 10. First embodiment apparatus 10 includes a housing 12 and cover means 14 for closing an outwardly facing opening 16 defined by housing 12.

Housing 12 comprises a lower portion 18 and a pair of upwardly extending ends 20. Lower portion 18 has an upper surface 22 thereon.

Extending longitudinally between ends 20 on upper surface 22 is a support means such as an elongated support 24. Support 24 defines a groove 26 therein. Groove 26 is preferably arcuate in cross section and defines slightly more than half a circle, as best seen in FIG. 2.

A substantially cylindrical sharpening element 28 is disposed in groove 26 and adapted to fit closely therein. Since groove 26 is slightly more than half (or 180°) of a circle, it will be seen by those skilled in the art that support 24 will retain sharpening element 28 in the position shown, as well as provide full support along a lower side 29 thereof.

Sharpening element 28 is preferably longer than support 24 so that longitudinal ends 30 thereof fit into inwardly facing openings 32 defined in ends 20 of housing 12. In this way, sharpening element 28 is fully retained, even if groove 26 were less than half a circle in cross section.

Sharpening element 28 is a recycled aluminum oxide sodium vapor streetlight bulb. Such bulbs are manufactured by General Electric Company and marketed as Lucalox® ceramic tubing. This ceramic is a polycrystalline translucent aluminum oxide ceramic. A minimum purity of 99.9% aluminum oxide assures highly stable properties. This purity is very similar to the high purity of sapphire (single crystal alumina). A typical chemical analysis of this material is shown in Table I.

TABLE I

| Trace Element | Parts Per Million Detected |
|---|---|
| Silicon | 50 |
| Iron | 4 |
| Calcium | 7 |
| Magnesium | 180 |
| Potassium | 50 |
| Sodium | 80 |
| Lithium | <1 |
| Molybdenum | 10 |
| Chromium | 2 |
| Copper | 4 |

This ceramic is used primarily for arc tubes in high-pressure sodium vapor lamps. It is characterized by a highly translucent appearance and looks very much like frosted glass.

The ceramic is essentially a single-phase material, manufactured by bonding aluminum oxide grains directly to each other. The fine-grain, high-purity aluminum oxide is processed at room temperature, then fired at temperatures higher than usual for ceramics. The resulting glass-free structure provides a high material density and a high temperature stability.

Mechanically, the Lucalox® ceramic is very hard and exhibits both a high compressive strength and a high modulus of rupture. It is capable of withstanding up to 25,000 psi and 1800° C. in uniaxial compression. Table II presents typical physical properties of Lucalox® ceramic.

TABLE II

| Property | Lucalox ® Ceramic |
|---|---|
| Microstructure | Polycrystalline |
| Crystalline phase | α Alumina |
| Purity | 99.9% Aluminum Oxide |
| Density | ≧3.9 gm/cm$^3$ |
| Porosity | Gas tight (essentially zero) |
| Average grain size | 30 Microns average |
| Melting point | 2,040° C. |
| Color | Translucent white |
| Hardness - KHN100 | 2190 |
| Hardness - Rockwell 30N | 89 |
| Modulus of rupture (polished samples) | $2.75 \times 10^8$ Pa |
| Compressive strength | $2.24 \times 10^8$ Pa |
| Young's modulus | $3.93 \times 10^{11}$ Pa |
| Modulus of rigidity | $1.58 \times 10^{11}$ Pa |
| Poisson's ratio | 0.23 |
| Light transmittance (using integrating sphere method) | Exceeds 87% total transmission throughout visible spectrum |

Electrically, Lucalox® ceramic demonstrates a high dielectric strength, low dissipation, and low loss factor.

The optical properties of Lucalox® ceramic result from its high density, high purity, and controlled grain size. It transmits wave-lengths from the near ultraviolet, through the visible spectrum, and into infrared.

This ceramic has a melting temperature of 2,040° C. and maintains high strength at temperatures that approach the melting point. The recommended maximum use temperature is 1900° C.

The thermal conductivity of Lucalox® ceramic is better than some metals, and since the ceramic is polycrystalline, the expansion is essentially uniform in all directions. The thermal shock resistance is very good.

The material is currently available from General Electric in tube form with a diameter range of five millimeters to ten millimeters, a 0.5 millimeter to one millimeter wall range, and a 25 millimeter to 26 millimeter length range. Initial tolerances on all dimensions except length are ±0.3 millimeters or one percent, whichever is greater. Length tolerances are ±0.5 millimeters for lengths less than 75 millimeters and ±1.0 millimeter for lengths from 75 millimeters to 260 millimeters.

These bulbs, like most ceramics, are fairly expensive initially. However, after the bulb has burned out or at least passed its normal life, it has essentially no value to the electrical utility which used it as a lamp bulb or the manufacturer. Previously, they would discard the old bulbs. However, it has been discovered that after the bulbs have gone through a typical life cycle, they provide an excellent sharpening element for the present invention.

When the bulbs are first manufactured, they are not suitable for use as a knife-sharpening element because the surface of a new light tube is too smooth. It is only after the bulb has had usage that it provides a goad sharpening element, because the usage causes the outer surface of the bulb to be roughened. The vapor and heat expansion and contraction of the ceramic tube forming the bulb causes wear and further causes the ceramic element to become more porous. Basically, this roughens the outer surface of the bulb. Because the bulb is made of a very hard material, namely aluminum oxide, it is an ideal abrasive for a knife sharpener.

A typical life of one of these sodium bulbs is approximately two years with approximately ten hours per day use, or 7120 hours. The recommended maximum use temperature is 1900° C., and the dielectric strength is 1700 volts per milligram. The bulbs are available in wattages of 100, 150, 250, 400 and 1,000.

Seen in FIGS. 1 and 2, cover means 14 is characterized by a cover 14 having a top portion 34 and a pair of downwardly extending sides 36. In this way, when cover 14 is in place, it totally encloses support 24 and sharpening element 28.

Figure 3:
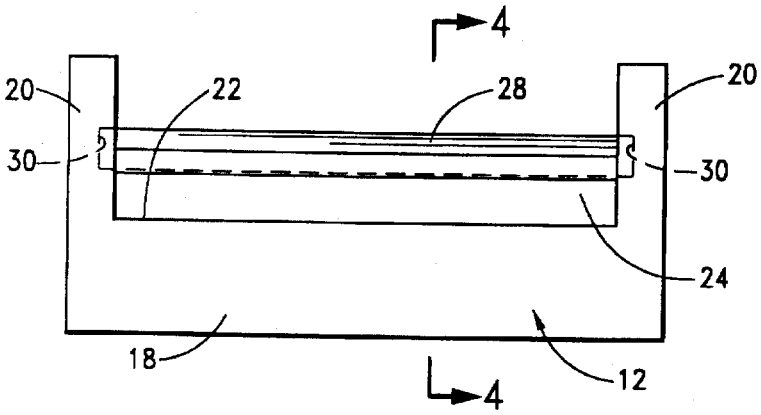
FIG. 3 shows the first embodiment with a cover removed.
Figure 4:
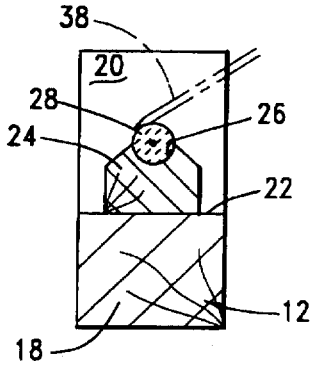
FIG. 4 is a cross section taken along lines 4—4 in FIG. 3.

FIGS. 3 and 4 illustrate the first embodiment with cover means 14 removed so that sharpening element 28 is exposed and may be engaged by a knife blade 38 for sharpening. The actual movement of blade 38 against sharpening element 28 is in a manner known in the art.

Figure 5:
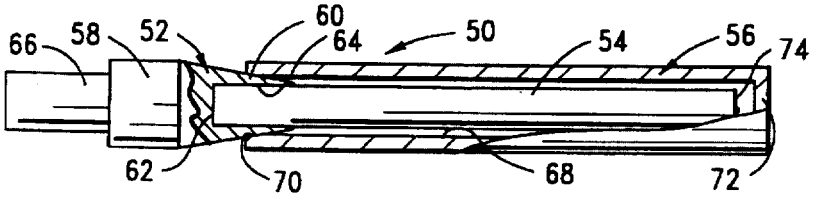
FIG. 5 illustrates a second embodiment of the knife-sharpening apparatus in elevation and partial longitudinal cross section.
Figure 6:
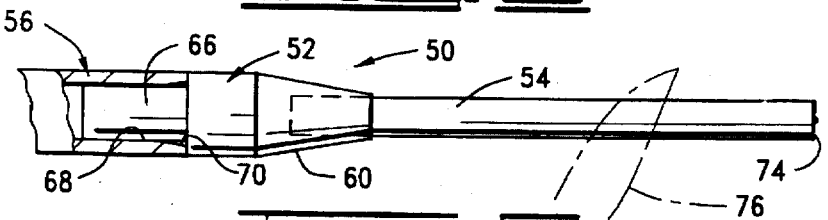
FIG. 6 illustrates the embodiment of FIG. 5 with a cover removed to expose a knife-sharpening element.

Referring now to FIGS. 5 and 6, a second embodiment of the knife-sharpening apparatus of the present invention is shown and generally designated by the numeral 50. This embodiment generally comprises support means 52 for supporting a sharpening element 54 and cover means 56 for covering the sharpening element when it is not in use.

In second embodiment 50, support means 52 is characterized by a handle 52 having a cylindrical portion 58 with a conical portion 60 extending therefrom. A proximate end 62 of sharpening element 54 fits within an opening 64 defined in conical portion 60 of handle 52. A smaller cylindrical portion 66 extends from larger cylindrical portion 58 in a direction opposite from conical portion 60.

Sharpening element 54 in second embodiment 50 is substantially identical to sharpening element 28 in first embodiment 10, and all of the details presented with regard to the material and use of sharpening element 28 also apply to sharpening element 54.

In second embodiment 50, cover means 56 is characterized by a sleeve 56. Sleeve 56 has a cylindrical bore 68 therein with a conical bore 70 at one end thereof. Conical bore 70 is adapted to receive conical portion 60 of handle 52 for a snug fit between the sleeve and handle. An opposite end 72 of sleeve 56 may be closed. It will thus be seen that sleeve 56 substantially encloses sharpening element 54 including distal end 74 thereof. FIG. 5 shows second embodiment 50 in a closed position.

FIG. 6 illustrates second embodiment 50 in an open position. In this position, the apparatus may be used by grasping handle 52 with one hand and moving a knife blade 76 across sharpening element 54 with the other hand. This sharpening movement is known in the art.

Cover 56 may be temporarily stored on handle 52 in the operating position by inserting cylindrical portion 66 of handle 52 into the open end of sleeve 56. Cylindrical portion 66 is adapted to fit closely within bore 68 in sleeve 56 so that the sleeve will stay in place. After sharpening, sleeve 56 may be repositioned in the closed position shown in FIG. 5.

It will be seen, therefore, that the knife-sharpening apparatus of the present invention is well adapted to carry out the ends and advantages mentioned, as well as those inherent therein. While presently preferred embodiments of the invention have been shown for the purposes of this disclosure, numerous changes in the arrangement and construction of the parts may be made by those skilled in the art. All such changes are encompassed within the scope and spirit of the appended claims.

What is claimed is:

1. A blade-sharpening apparatus comprising:

a sharpening element comprising a ceramic tube subjected to heat expansion and contraction cycles such that the surface thereof is made porous; and support means for supporting said sharpening element during a sharpening operation in which a blade is moved across an outer surface of the sharpening element.

2. The apparatus of claim 1 wherein said ceramic tube is a recycled streetlight bulb.

3. The apparatus of claim 2 wherein said bulb is a sodium vapor bulb.

4. The apparatus of claim 1 wherein said tube is substantially cylindrical.

5. The apparatus of claim 1 wherein said support means is engaged with at least one end of said sharpening element.

6. The apparatus of claim 1 wherein said support means provides support along a substantial length of an outer surface of the sharpening element.

7. The apparatus of claim 6 further comprising a housing having a base portion, wherein said support means extends from said base portion.

8. The apparatus of claim 7 wherein said support means and base portion are integrally formed.

9. The apparatus of claim 7 wherein:

said base portion has a housing end extending therefrom, said housing end defining an opening therein; and an end of said sharpening element is disposed in said opening in said housing end.

10. The apparatus of claim 9 wherein said housing end of said housing is one of a pair of housing ends; and said cover means is characterized by a cover extending longitudinally between said housing ends.

11. The apparatus of claim 1 wherein:

said support means is characterized by a handle defining an opening in an end thereof; and a proximate end of said sharpening element is disposed in said opening in said handle.

12. The apparatus of claim 11 wherein said cover means is characterized by a sleeve disposed around said sharpening element.

13. The apparatus of claim 12 wherein said sleeve is adapted for tightly fitting engagement with a portion of said handle adjacent to said sharpening element when in a closed position.

14. The apparatus of claim 12 wherein said sleeve is adapted for tightly fitting engagement with a portion of said handle opposite said sharpening element when in an operating position.

15. A blade-sharpening apparatus comprising:

a handle; and an elongated sharpening element engaged with said handle, said sharpening element comprising a ceramic light bulb subjected to heating and cooling cycles such that the surface thereof is roughened.

16. The apparatus of claim 15 further comprising a sleeve disposable around said sharpening element and engagable with said handle such that said sharpening element is substantially enclosed when said sleeve is in a closed position.

17. The apparatus of claim 16 wherein said sleeve is engagable with an opposite end of said handle from said sharpening element when in an operating position.

18. The apparatus of claim 15 wherein said sharpening element is substantially cylindrical.

19. A blade-sharpening apparatus comprising:

a housing comprising:

a base portion having a surface thereon; and a pair of spaced ends extending from said base portion, each of said ends defining an opening therein;

a support disposed along said surface of said base position between said ends; and a sharpening element disposed on said support such that opposite longitudinal ends of said sharpening element are disposed in said openings in said ends of said housing, said sharpening element comprising a ceramic light bulb subjected to heating and cooling cycles such that the surface thereof is roughened.

20. The apparatus of claim 19 wherein:

said support defines a groove therein having an arcuate cross section; and said sharpening element is substantially cylindrical and adapted for engaging said groove in said support.

21. The apparatus of claim 19 wherein said support and said base portion are integrally formed.

22. The apparatus of claim 19 further comprising a cover disposable between said ends of said housing and adapted for enclosing said sharpening element when in a closed position.

23. The apparatus of claim 15 wherein said light bulb is a sodium vapor bulb.

24. The apparatus of claim 15 wherein said ceramic light bulb is formed of aluminum oxide.

25. The apparatus of claim 19 wherein said light bulb is a sodium vapor bulb.

26. The apparatus of claim 19 wherein said ceramic light bulb is formed of aluminum oxide.

* * * * *